US006386486B1

(12) United States Patent
Speranza

(10) Patent No.: US 6,386,486 B1
(45) Date of Patent: May 14, 2002

(54) METHOD AND APPARATUS FOR INDICATING THE PRESENCE OF A TRAIN AT A RAILROAD CROSSING

(76) Inventor: Bernard E. Speranza, 9216 White Oak Ave., Munster, IN (US) 46321

( * ) Notice: Subject to any disclaimer, the term of this patent is extended or adjusted under 35 U.S.C. 154(b) by 0 days.

(21) Appl. No.: 09/756,388

(22) Filed: Jan. 8, 2001

(51) Int. Cl.[7] ..... B61L 29/00
(52) U.S. Cl. ..... 246/293; 246/122 R
(58) Field of Search ..... 246/124, 167 A, 246/292, 293, 294, 295, 296, 473.1, 477, 488, 122 R

(56) References Cited

U.S. PATENT DOCUMENTS 5,735,492 A * 4/1998 Pace ..... 246/125
5,864,304 A * 1/1999 Gerszberg et al. ..... 340/903
5,868,360 A * 2/1999 Bader et al. ..... 246/202
5,954,299 A * 9/1999 Pace ..... 246/293
6,179,252 B1 * 1/2001 Roop et al. ..... 246/293
6,241,197 B1 * 6/2001 Harland ..... 246/293

* cited by examiner

*Primary Examiner*—Mark T. Le
(74) *Attorney, Agent, or Firm*—Wallenstein & Wagner, Ltd.

(57) ABSTRACT

A method and apparatus for indicating the presence of one or more trains near a railroad crossing having at least two train tracks. The signaling system has a first sensor for detecting the presence of the first train near or approaching the railroad crossing and a second sensor for detecting the presence of the second train near or approaching the railroad crossing. A warning signal having a first and second mode is responsive to the sensors such that the detection of either the first train or the second train generates the first mode warning signal and the detection of both the first train and the second train generates the second mode warning signal.

20 Claims, 2 Drawing Sheets

METHOD AND APPARATUS FOR INDICATING THE PRESENCE OF A TRAIN AT A RAILROAD CROSSING

The present invention is generally related to warning signals at a railroad crossing. More specifically, the present invention is related to indicating the presence of one or more trains near or approaching a railroad crossing.

BACKGROUND OF INVENTION

Various safety precautions are implemented at railroad crossings. Trains are installed with bells, horns and lights and the railroad crossing generally includes signs, lights, audible alarms and gates to notify motorists and pedestrians of the presence of trains near or approaching the railroad crossing. The presence of an approaching train activates these safety mechanisms prior to the train entering the railroad crossing. The warning signal usually continues to operate for a short period of time after the train has passed through the railroad crossing. These safety devices have been known to malfunction and prematurely activate without a train approaching the railroad crossing, thus causing motorists and pedestrians to doubt the working condition and reliability of the warning signal. Motorists and pedestrians have been known to ignore a railroad crossing warning signal and/or to avoid the safety mechanisms.

Generally, a single warning signal exists to warn pedestrians and motorists of the presence of one or more trains near a railroad crossing. At a railroad crossing having multiple train tracks, there is no type of indicator to passers by that an additional train is approaching the railroad crossing after the warning signal has been activated by an earlier approaching train. Thus, after a first train passes through a railroad crossing, an anxious motorist or pedestrian may ignore the warning signal or incorrectly determine that the remaining warning signal is associated with the previously crossing, now departing, train and will then attempt to cross the train tracks when in fact a second approaching train has activated the warning signal and will soon be entering the railroad crossing.

This invention is directed to solving these and other problems.

SUMMARY OF THE INVENTION

According to a first embodiment of the present invention, a signaling system indicates the presence of a first train and a second train near a railroad crossing having at least two train tracks. The signaling system comprises a first sensor for detecting the presence of the first train near or approaching the railroad crossing on a first railroad track, and a second sensor for detecting the presence of the second train near or approaching the railroad crossing on a second railroad track. A warning signal having a first mode and a second mode is displayed dependent upon whether one or more trains are near or approaching the railroad crossing. The warning signal being responsive to the first and second sensors such that the detection of either the first train or the second train generates the first mode warning signal and the detection of both the first train and the second train generates the second mode warning signal.

Another embodiment of the present invention is related to a method of providing a warning signal at a railroad crossing having at least two train tracks. The warning signal is responsive to the presence of one or more trains near the railroad crossing. The method comprises sensing a first train near or approaching the railroad crossing and sensing a second train near or approaching the railroad crossing. A warning signal comprising a first mode and a second mode is generated in response to the first and second sensors such that the sensing of either the first train or the second train generates a first mode warning signal and the sensing of both the first train and the second train generates a second mode warning signal. The appropriate warning signal is displayed visually or aurally to motorists and pedestrians near the railroad crossing.

Other advantages and aspects of the present invention will become apparent upon reading the following description of the drawings and detailed description of the invention.

DETAILED DESCRIPTION OF PREFERRED EMBODIMENT

Figure 2:
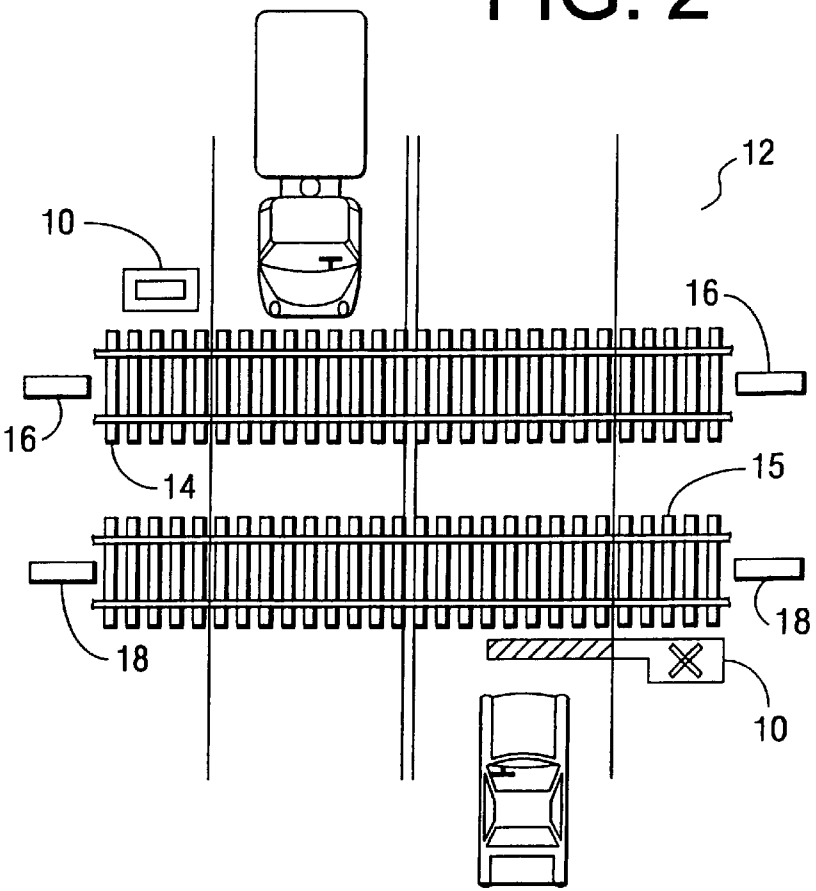

While this invention is susceptible of embodiments in many different forms, there is shown in the drawings and will herein be described in detail a preferred embodiment of the invention with the understanding that the present disclosure is to be considered as an exemplification of the principles of the invention and is not intended to limit the broad aspect of the invention to the embodiment illustrated.

Figure 1:
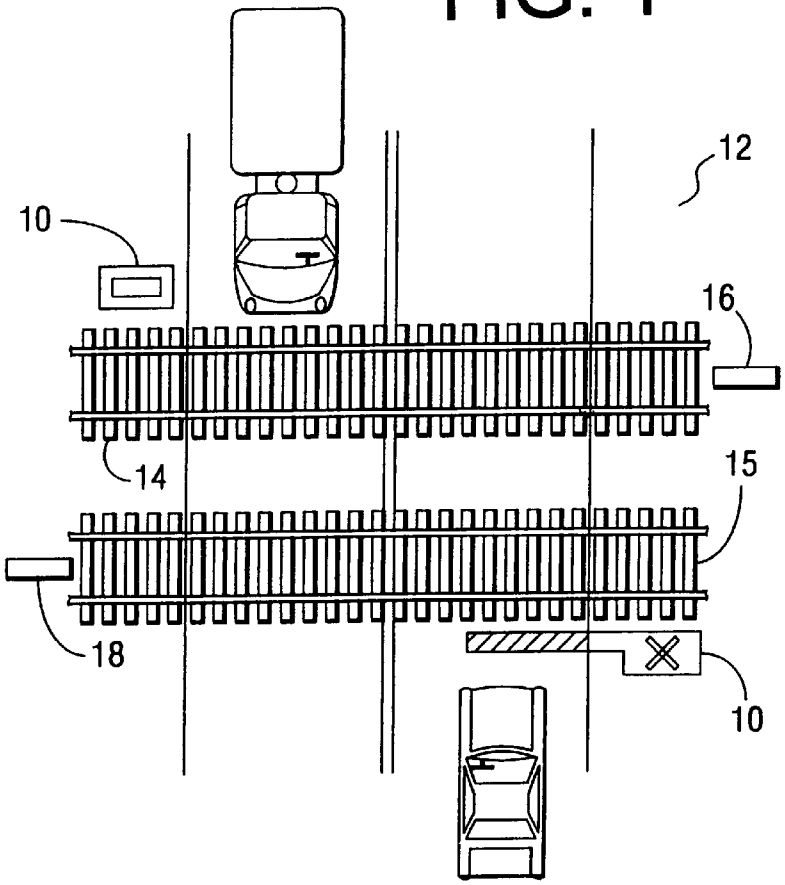
FIG. 1 is a drawing of a railroad crossing depicting one embodiment of the present invention; and, FIGS. 2 and 3 are drawings of railroad crossings depicting further embodiments of the present invention.

FIG. 1 depicts an embodiment of the present invention related to a signaling system for indicating the presence of a first train and a second train near a railroad crossing 12 having at least two train tracks 14, 15. The signaling system comprises a first sensor 16 for detecting the presence of the first train approaching the railroad crossing 12 on the first railroad track 14. A second sensor 18 detects the presence of the second train approaching the railroad crossing 12 on the second railroad track 15. A warning signal, comprising a first mode and a second mode, is responsive to the first and second sensors 16, 18 such that the detection of either the first train or the second train generates the first mode warning signal and the detection of both the first train and the second train generates the second mode warning signal.

The sensors 16, 18 are operably connected to a displaying means 10 located near the railroad crossing 12 for displaying the appropriate warning signal. The warning signal can be displayed 10 in any form used in similar warning systems, i.e., lights, sounds, flashing lights, sirens, strobes, combinations of the above, etc.

The sensors 16, 18 monitor the presence of approaching trains. If one train is detected by the sensors 16, 18, the first mode warning signal is generated. If more than one train is detected approaching the railroad crossing 12, the warning signal is generated in the second mode and displayed 10 at the railroad crossing 12 to motorists and pedestrians. Preferably, the first mode warning signal operates at a predetermined rate, i.e., a constant or flashing signal. The second mode warning signal will operate at a different rate, i.e., faster, slower, intermittent, etc., than the first mode warning signal so that motorists and pedestrians can identify the difference between the first mode and second mode warning signals and thus recognize that a second train is near, or fast approaching, the railroad crossing 12.

It is understood by those of ordinary skill in the art of railroad crossing signaling, that any type of sensor 16, 18 can be utilized with this invention, i.e., motion sensors, contact sensors, optical sensors, etc.

Alternatively, each sensor 16, 18 can generate a signal in response to the presence of a train near or approaching the railroad crossing. A first signal is generated in response to the first sensor 16 detecting the presence of the first train approaching the railroad crossing 12 and a second signal is generated in response to the second sensor 18 detecting the presence of the second train approaching the railroad crossing 12. The warning signal is responsive to the first and second signals such that the detection of either the first train or the second train generates the first mode warning signal and the detection of both the first train and the second train generates the second mode warning signal.

Figure 3:
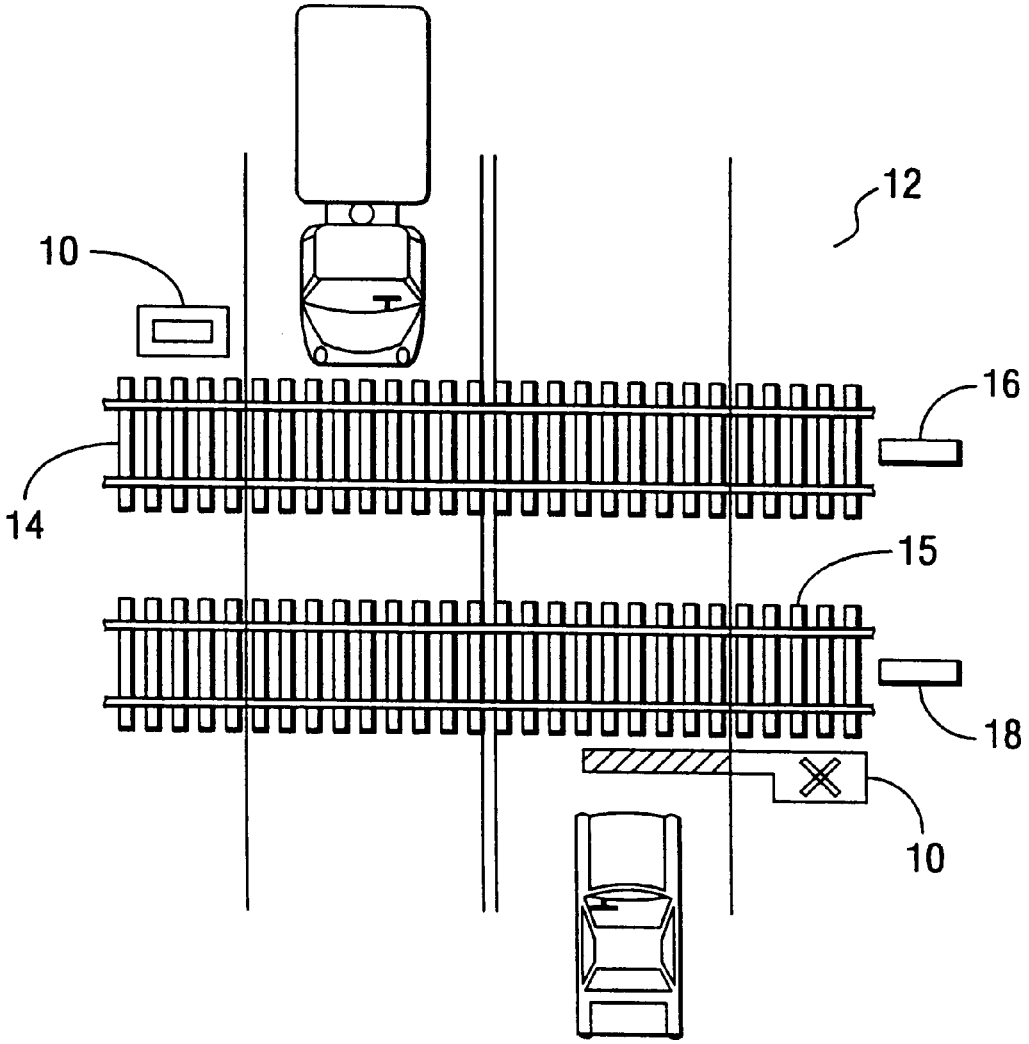

FIG. 2 depicts an alternative embodiment of the present invention wherein each sensor 16, 18 is located on both sides of the railroad crossing 12. In a further embodiment of the present invention, each sensor 16, 18 is a bi-directional sensor located on either side of the railroad crossing 12 as shown in FIG. 3. The first and second sensors 16, 18 are operably connected to the displaying means 10. The pair of sensors 16, 18 monitor approaching trains on the respective tracks from either direction. The first sensor 16 detects a near or approaching train on the first track 14 from either direction. The second sensor 18 similarly detects a near or approaching train on the second track 15 from either direction. The sensors 16, 18 and the displaying means 10 are operably connected using mechanical, electrical (wired or wireless) or optical technology, or any combination thereof. As discussed earlier, if a single train is detected near or approaching the railroad crossing 12, a first mode warning signal is displayed 10 to passers by. The detection of two trains near or approaching the railroad crossing 12 generates a second mode warning signal that will be displayed 10 to motorists and pedestrians to indicate that more than one train is nearby or approaching the railroad crossing 12. Alternatively, a single sensor capable of performing the functions of the first and second sensors 16, 18 can replace the pair of sensors 16, 18 operably connected to the displaying means 10.

The present invention can be implemented with railroad crossings 12 having a plurality of train tracks. A sensor for detecting the presence of a train is operably connected to each railroad track. Each railroad track's sensor generates a signal when an approaching train has been detected. The warning signal is responsive to all signals generated by the sensors such that the detection of a single train generates the first mode warning signal and the detection of more than one train generates the second mode warning signal. The appropriate warning signal is then displayed through the displaying means 10.

While the specific embodiment has been illustrated and described, numerous modifications come to mind without significantly departing from the spirit of the invention, and the scope of protection is only limited by the scope of the accompanying claims.

I claim:

1. A signaling system for indicating the presence of a first train and a second train near a railroad crossing having at least two train tracks, the signaling system comprising:

a first sensor for detecting the presence of the first train near the railroad crossing on a first railroad track;

a second sensor for detecting the presence of the second train near the railroad crossing on a second railroad track; and, a warning signal comprising a first mode and a second mode, the warning signal being responsive to the first and second sensors such that the detection of either the first train or the second train generates the first mode warning signal and the detection of both the first train and the second train generates the second mode warning signal.

2. The signaling system of claim 1 further comprising displaying means being responsive to the warning signal for displaying the first or second mode warning signal.

3. The signaling system of claim 2 wherein the displaying means for displaying the warning signal is a light.

4. The signaling system of claim 3 wherein the first mode warning signal comprises a predetermined operating rate and the second mode warning signal comprises an operating rate different than that of the first mode warning signal.

5. The signaling system of claim 3 wherein the first mode warning signal comprises a color and the second mode warning signal comprises a different color.

6. The signaling system of claim 4 wherein the first mode warning signal comprises a color and the second mode warning signal comprises a different color.

7. A signaling system for indicating the presence of a first train and a second train near a railroad crossing having at least two train tracks, the signaling system comprising:

a first sensor for detecting the presence of the first train near the railroad crossing on a first railroad track;

a second sensor for detecting the presence of the second train near the railroad crossing on a second railroad track;

a first signal generated in response to the first sensor detecting the presence of the first train near the railroad crossing;

a second signal generated in response to the second sensor detecting the presence of the second train near the railroad crossing; and, a warning signal comprising a first mode and a second mode, the warning signal being responsive to the first and second signals such that the detection of either the first train or the second train generates the first mode warning signal and the detection of both the first train and the second train generates the second mode warning signal.

8. The signaling system of claim 7 further comprising a displaying means being responsive to the warning signal for displaying the first and second modes of the warning signal.

9. The signaling system of claim 8 wherein the displaying means for displaying the warning signal is a light.

10. The signaling system of claim 9 wherein the first mode warning signal comprises a predetermined operating rate and the second mode warning signal comprises an operating rate different than that of the first mode warning signal.

11. The signaling system of claim 9 wherein the first mode warning signal comprises a color and the second mode warning signal comprises a different color.

12. The signaling system of claim 10 wherein the first mode warning signal comprises a color and the second mode warning signal comprises a different color.

13. A method for generating a warning signal at a railroad crossing having at least two train tracks, the method comprising the steps of:

providing a first sensor for detecting the presence of a first train near the railroad crossing on a first railroad track and a second sensor for detecting the presence of a second train near the railroad crossing on a second railroad track;

sensing the first train near the railroad crossing;

sensing the second train near the railroad crossing; and, generating the warning signal comprising a first mode and a second mode, the warning signal being responsive to the sensing of the first and second train wherein the first mode warning signal is generated when either the first or second train is near the railroad crossing and the second mode warning signal is generated when both the first and second train are near the railroad crossing.

14. The method for generating a warning signal of claim 13 further comprising the step of:

displaying the generated warning signal.

15. The method for generating a warning signal of claim 14 wherein the first mode warning signal comprises a light having a predetermined operating rate and the second mode warning signal comprises a light having an operating rate different than the first mode warning signal.

16. The method for generating a warning signal of claim 15 wherein the first mode warning signal comprises a color and the second mode warning signal comprises a different color.

17. The method for generating a warning signal of claim 13 wherein the first mode warning signal comprises a color and the second mode warning signal comprises a different color.

18. A signaling system for indicating the presence of a first train and a second train near a railroad crossing, the signaling system comprising:

a warning signal with a first mode, the warning signal being operably responsive to a first sensor and a second sensor and a second mode warning signal being operably responsive to the first and second sensors, wherein the detection of either the first train or the second train generates the first mode warning signal and the detection of both the first train and the second train generates the second mode warning signal.

19. The signaling system of claim 18 wherein the second mode warning signal comprises an operating rate different than that of the first mode warning signal.

20. The signaling system of claim 18 wherein the second mode warning signal comprises a color different than that of the first mode warning signal.

* * * * *